US007494098B1

(12) United States Patent
Fulda

(10) Patent No.: US 7,494,098 B1
(45) Date of Patent: Feb. 24, 2009

(54) WASTE CONTAINER HOLDING SYSTEM

(76) Inventor: Richard Fulda, 34 W. 962 N. James Dr., St. Charles, IL (US) 60174

( * ) Notice: Subject to any disclaimer, the term of this patent is extended or adjusted under 35 U.S.C. 154(b) by 451 days.

(21) Appl. No.: 11/339,641

(22) Filed: Jan. 25, 2006

Related U.S. Application Data

(63) Continuation-in-part of application No. 10/429,310, filed on May 5, 2003, now abandoned.

(51) Int. Cl.
*A47G 1/17* (2006.01)

(52) U.S. Cl. ..... 248/206.5; 248/156; 220/483

(58) Field of Classification Search ..... 248/683, 248/209.4, 156, 206.5; 220/484, 483, 495.06, 220/603

See application file for complete search history.

(56) References Cited

U.S. PATENT DOCUMENTS

| | | | | |
|---|---|---|---|---|
| 2,838,264 | A | 6/1958 | Hill | |
| 2,966,992 | A | 1/1961 | Dunkelberger et al. | |
| 3,201,075 | A | 8/1965 | Sievers | |
| 3,776,387 | A * | 12/1973 | Brent | 211/70.6 |
| 4,072,286 | A | 2/1978 | Foncannon | |
| 4,484,682 | A | 11/1984 | Crow | |
| 4,930,653 | A * | 6/1990 | Machado | 220/23.4 |
| 5,186,350 | A | 2/1993 | McBride | |
| 5,213,294 | A | 5/1993 | DeBord | |
| 5,301,822 | A * | 4/1994 | Coleman et al. | 211/70.6 |
| 5,367,278 | A | 11/1994 | Yoshikawa | |
| 6,786,349 | B2 * | 9/2004 | Najd | 220/484 |
| 6,971,529 | B1 * | 12/2005 | Shapiro | 211/188 |
| 2002/0130231 | A1 | 9/2002 | Winnard | |
| 2002/0175131 | A1 | 11/2002 | Johnson | |

* cited by examiner

*Primary Examiner*—Amy J. Sterling
(74) *Attorney, Agent, or Firm*—Thomas R. Vigil

(57) ABSTRACT

The waste container holding system comprises: a magnetic grid including at least two, spaced, elongate magnetizable metal bar units fixed to or in a ground surface, each elongate magnetizable metal bar unit comprising at least one elongate metal bar having a length of at least two feet and at least two magnets positioned adjacent to each elongate metal bar in each elongate magnetizable metal bar unit and spaced along the length of each elongate metal bar. The elongate metal bar units are spaced from each other when mounted in one of the ground, asphalt or concrete with a desired spacing between the at least two elongate metal bar units. The system also includes a generally flat magnetizable plate fixed at or to a bottom surface of at least one waste container or in the bottom of the container closely adjacent to the bottom surface whereby the at least one waste container is held to the magnetic grid against ambient wind by the magnetic force between the plate and the magnetic grid.

22 Claims, 6 Drawing Sheets

WASTE CONTAINER HOLDING SYSTEM

BACKGROUND OF THE INVENTION

1. Field of the Invention

The present invention relates to a waste container holding system and, more specifically, to a system for holding an empty trash can, garbage can or waste receptacle, which is placed outdoors, from being blown away by strong winds. The system includes a grid or array of magnets, which are fixed to or in the ground or to or in an asphalt or concrete driveway together with a magnetizable, e.g., steel or iron, plate fixed at, to or in the bottom of each waste can or receptacle.

2. Description of the Prior Art

Heretofore, a variety of trash can or garbage can securing devices have been proposed. Examples of these analogous and non-analogous holding systems are disclosed in the following analogous and non-analogous U.S. patents:

| PATENT | PATENTEE |
|---|---|
| 2,838,264 | Hill |
| 3,201,075 | Sievers |
| 4,072,286 | Foncannon |
| 4,084,701 | White |
| 4,741,494 | Voornas |
| 4,995,529 | Sher |
| 5,213,294 | DeBord |
| 6,786,349 | Najd |

The Najd patent teaches a magnet fixed in the bottom of a waste receptacle or garbage can and a flat plate portion anchored in the ground by at least one spike.

As will be described in greater detail hereinafter, the prior art trash can holding systems referred to above lead away from the teachings of the present invention and the use of a magnet or magnetic grid or array fixed to or in the ground or to or in a driveway for holding a trash can or similar receptacle having a ferromagnetic, iron or magnetizable plate mounted at, to or in the bottom of the trash can or other receptacle and placed on the magnetic grid or array.

There has been proposed, non-analogous containers, such as for holding food, a beverage, or a variety of other things, that have a magnet or magnets mounted therein to permit attachment of the container to a steel, iron or other magnetizable surface. Such magnet attaching containers are disclosed in the following U.S. patents:

| PATENT | PATENTEE |
|---|---|
| 4,484,682 | Crow |
| 5,186,350 | McBride |
| 5,367,278 | Yoshikawa |

Also, a non-analogous method for temporarily holding a parts receiving, non-ferrous bin or box having a ferrous plate secured to the bottom thereof to a magnetic holding panel in the bottom of a parts tray is disclosed in abandoned U.S. published patent application number US 2002/0130231.

Further, non-analogous magnetic holders comprising magnets and ferromagnetic bars secured to a vertical surface for releasably holding magnetizable articles such as knives and chisels to the vertical surface are disclosed in U.S. Pat. No. 2,966,992 and in abandoned U.S. published application number US 2002/0175131.

However, heretofore, a waste container holding system including a magnetic grid fixed to or in a supporting surface such as, earth, asphalt or concrete, for holding a waste container having a ferromagnetic plate at or in the bottom thereof for preventing the waste container from being blown away by high winds, as described and claimed herein, has not been previously suggested or proposed.

BRIEF SUMMARY OF THE INVENTION

According to the present invention there is provided a waste container holding system comprising: a magnetic grid including at least two, spaced, elongate magnetizable metal bar units fixed to or in a ground surface, each elongate metal bar unit comprising at least one elongate metal bar and at least two magnets positioned adjacent to each elongate bar in each elongate magnetizable metal bar unit and spaced along the length of each elongate bar, the elongate magnetizable metal bar units being spaced from each other when mounted in or to the ground, asphalt or concrete with a desired spacing between the at least two elongate bar units, and at least one magnetizable plate fixed to the bottom surface of at least one waste container and or in a bottom of the waste container closely adjacent to the bottom surface and the at least one waste container being held to the magnetic grid against ambient wind by the magnetic force between the plate and the magnetic grid.

1 forming another embodiment of the waste container holding system of the present invention.

DETAILED DESCRIPTION OF THE PREFERRED EMBODIMENTS

Figure 1:
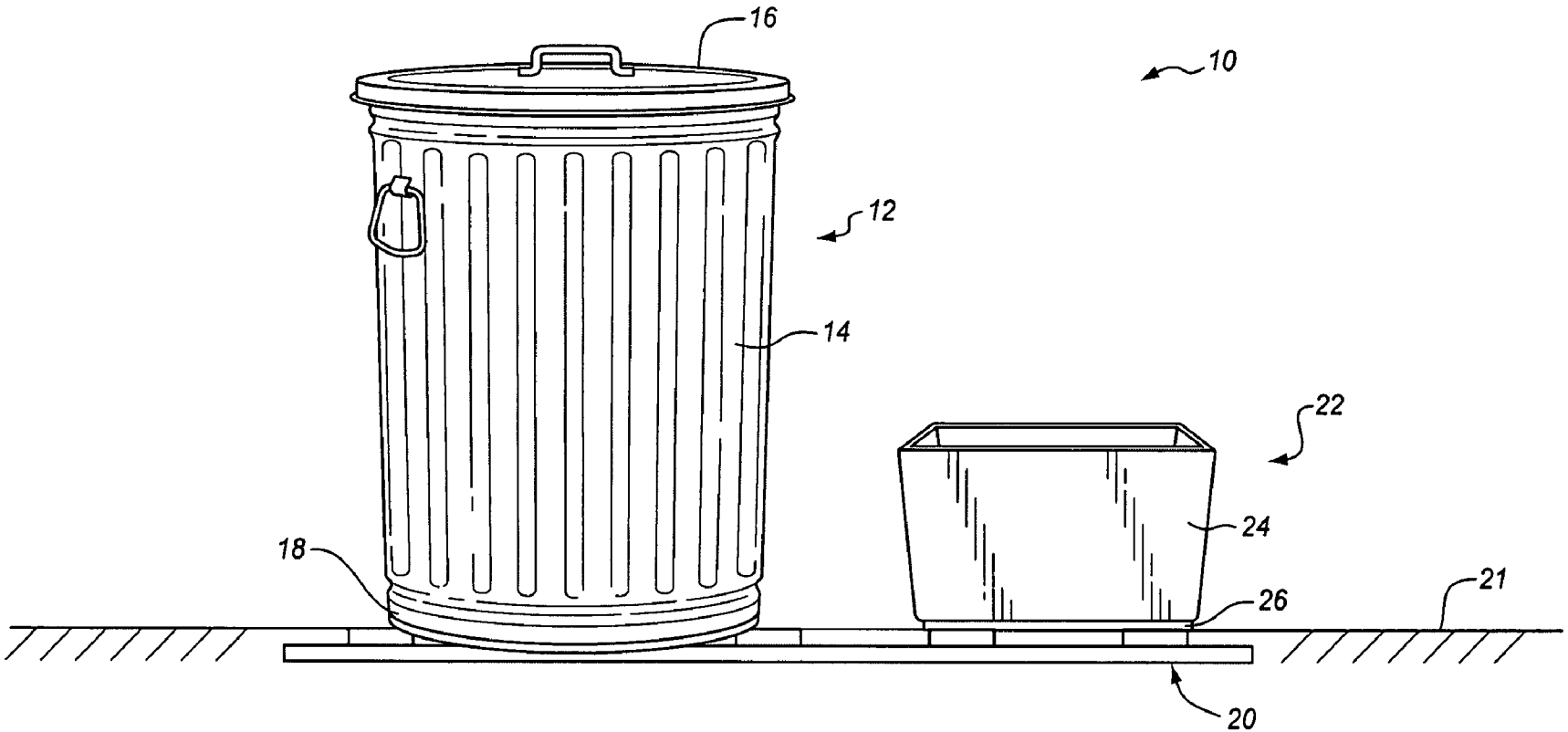
FIG. 1 is a side elevational view of the waste container holding system of the present invention and shows a trash can and a recycle bin magnetically held on a grid or array of bars and magnets.

Referring now to FIG. 1, there is illustrated therein a waste container holding system 10, which is constructed according to the teachings of the present invention and which includes a waste can or container 12, having a container body 14 and a cover 16. According to the teachings of the present invention, a magnetizable plate, such as a steel or iron sheet or plate 18, is fixed to the bottom of the container body, such as with an adhesive or fasteners. The sheet or plate 18 can have a thickness between one thirty-second inches (1/32") and one-quarter inch (1/4") and one preferred thickness is one-sixteenth inch (1/16").

The waste container holding system 10, further includes a grid 20 of elongate magnetizable metal bar units 52, 54, 56 and 58 including a plurality of magnets 40, (FIG. 2) which is fixed to or in a ground surface 21, such as to or in earth, asphalt or concrete.

Also shown is a waste recycle basket or receptacle 22, having a basket body 24 and a magnetizable plate, such as a steel or iron plate 26, similar to plate 18, fixed to the bottom thereof.

It will be understood that the plate 18 or 26, can be mounted inside or outside the bottom, or even in the bottom wall, of the container body 14 or 24. Preferably, the plate 18 or 26 is mounted to the outside of the bottom of the body 14 or 24.

Figure 2:
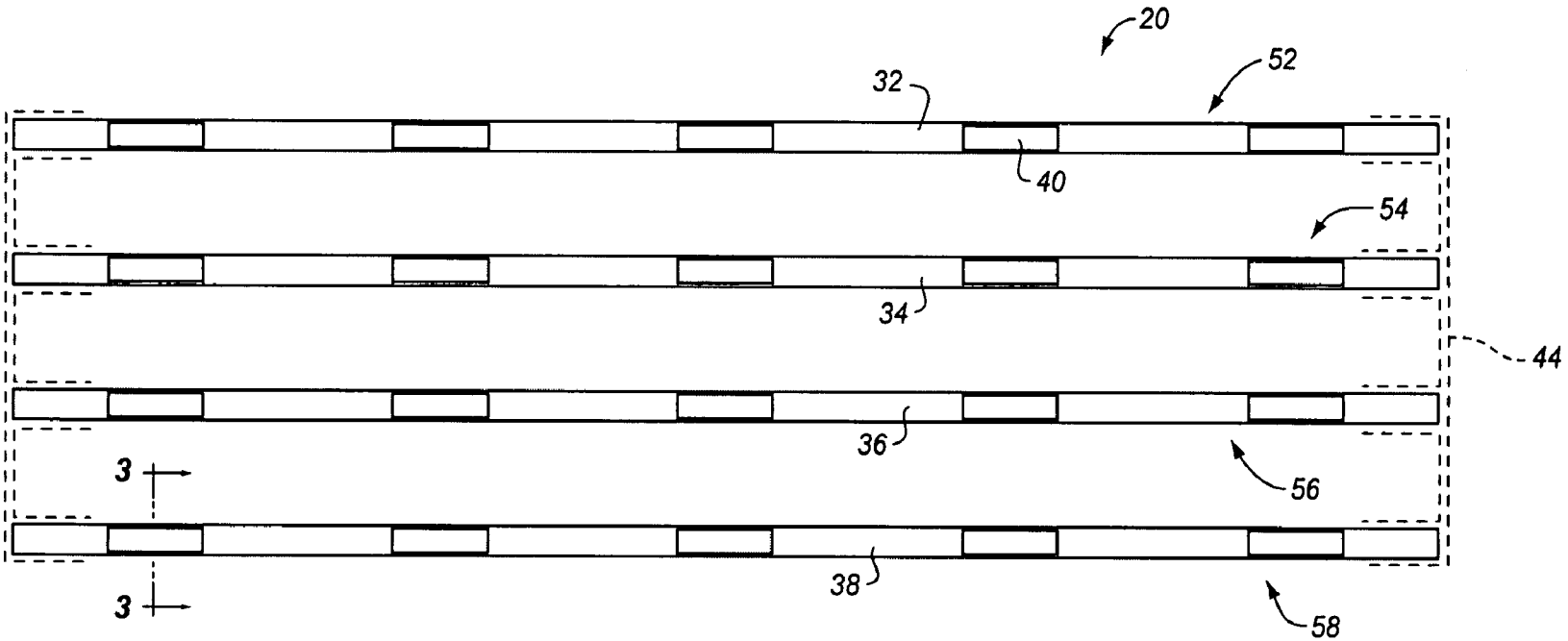
FIG. 2 is a plan view of one magnetic grid constructed according to the teachings of the present invention and placed into the earth or in a driveway such that the top of the magnets in the grid are flush with the ground or driveway surface and such grid forms part of the waste container holding system shown in FIG. 1.

Referring now to FIG. 2 in greater detail, there is illustrated therein the magnet grid 20, forming part of the waste container holding system 10, for holding an empty trash container 12, from being blown away.

Figure 5:
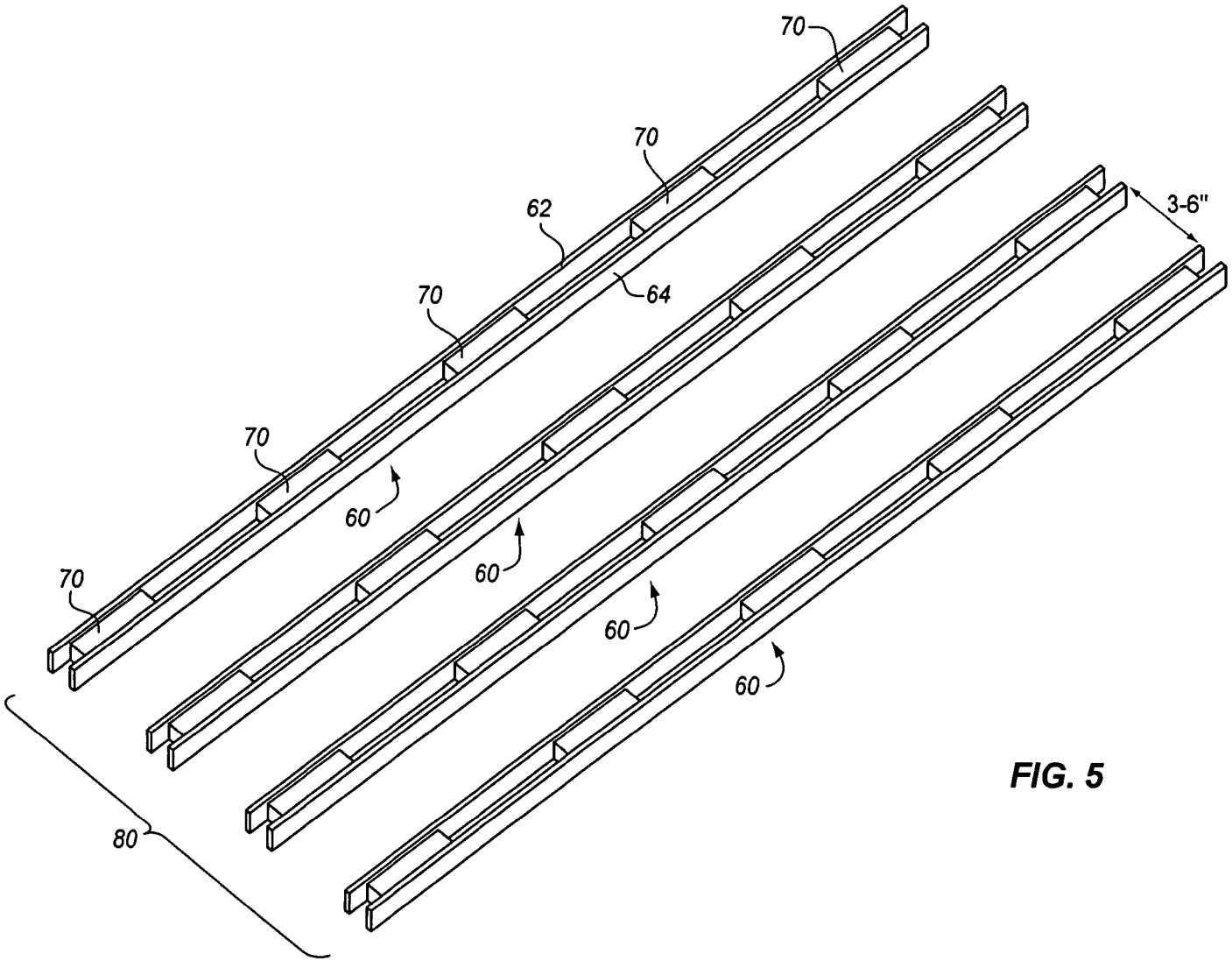
FIG. 5 is a top plan view of a magnetic grid constructed from four (4) of the elongate magnetizable metal bar units shown in FIG. 4.

While one specific grid 20, is shown for purposes of illustration, it is to be understood that the grid can take many different shapes. For example another magnetic grid 80 with elongate magnetizable metal bar units 60 having two elongate metal bars 62 and 64 and a plurality of magnets 70 is shown in FIG. 5 and described below.

The grid 20, includes four (4) iron or steel bars 32, 34, 36 and 38. It is to be understood that the steel bars used can have a length between two (2) and one-thousand feet (1,000') for making a grid. The illustrated grid 20 comprises magnetizable bars 32-38, having a length of five feet (5') and spaced apart from each other to form the grid 20.

Figure 3:
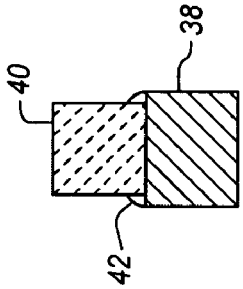
FIG. 3 is an end view of one of the metal bars of the grid shown in FIG. 2 and shows epoxy extending from the top of the bar and along part of one side of each magnet mounted on the bar for holding the magnets in place on the bar.

In the specific environment shown in FIG. 2, each bar 32-38, of the magnet grid 20, has a thickness of one eighth (1/8" or 0.125"), and a width of one and one quarter inches (1 1/4") and are spaced apart from one another by three to six inches (3-6"). On each bar 32-38, there are positioned five (5) magnets 40, which are spaced apart from each other by nine inches (9") on each bar 32, 34, 36 or 38 with the end magnets positioned one (1") inwardly from each end of each bar 32, 34, 36, and 38 and fixed to each bar 32-38, by epoxy 42, as best shown in FIG. 3.

Each magnet 40 is four inches (4") long, one inch (1") wide and one inch (1"), thick. The magnets 40 are preferably ceramic grade 5 to grade 8 magnets, which can be obtained from a number of sources here and abroad, such as from Bunting Magnet Company of Elk Grove, Ill. The epoxy 42 is placed on the one eighth inch (1/8") surface on the top of each bar 32-38, adjacent each magnet 40.

It will be appreciated that with four (4) bars 32-38, each being five feet (5') long and each having a thickness of one eighth inch (1/8") and a width of one and one quarter inches (1 1/4") separated from adjacent bars by 3 to 6 inches (3-6"), preferably 4 and 1/3", a magnetic grid 20, of five feet (5') by one and a half feet (1 1/2') is created as shown in FIG. 2.

While the magnetizable, steel or iron bars 32-38, can be placed in the ground with the spacing shown in FIG. 2, to create the magnet grid 20, if desired, a plastic framework 44, shown in phantom, can be provided for holding the bars 32-38, in the specific desired spacing of the grid or array 20, as shown in FIG. 2 when the grid is being mounted in the ground.

The bars 32-38 and magnets 40 form four elongate magnetizable metal bar units 52, 54, 56 and 58 which are arranged and embedded in the ground surface 21 of earth, asphalt or concrete to form the magnetic grid 20.

Figure 6:
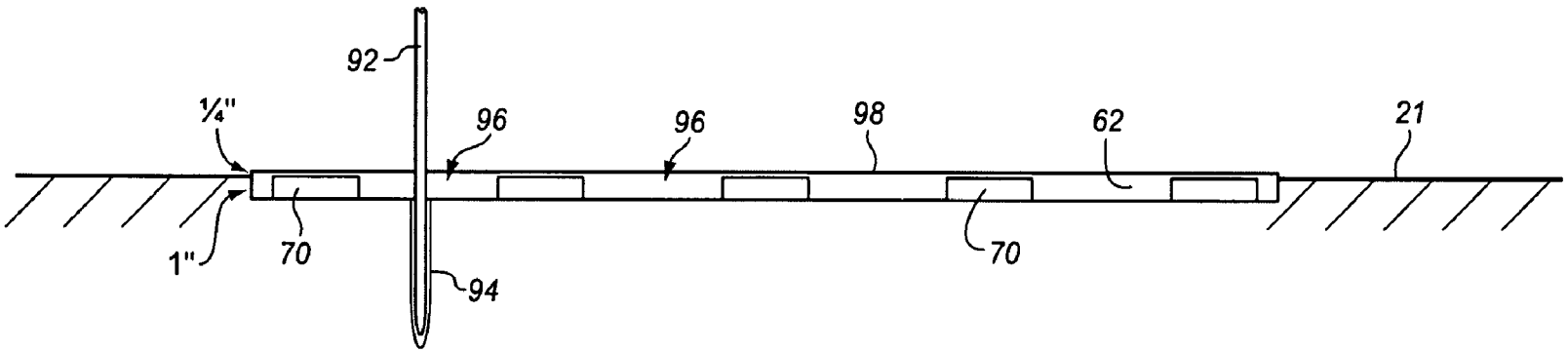
FIG. 6 is a side elevational sectional view of one of the elongate magnetizable metal bar units embedded substantially in the ground shown in FIG. 5, is taken along line 6-6 of FIG. 5 and shows an installer creating a hole in the ground for receiving a fluid hardenable material, such as non-shrinkable grout.
Figure 7:
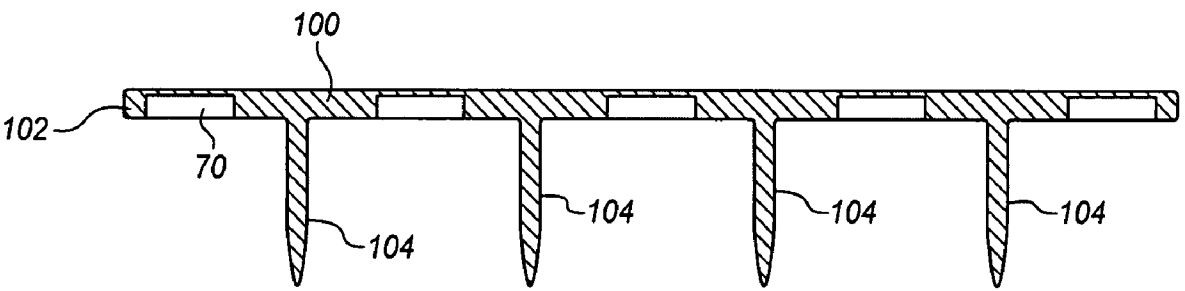
FIG. 7 is a side elevational view of the hardened grout around four magnets placed in the ground and between two elongate bars.
Figure 8:
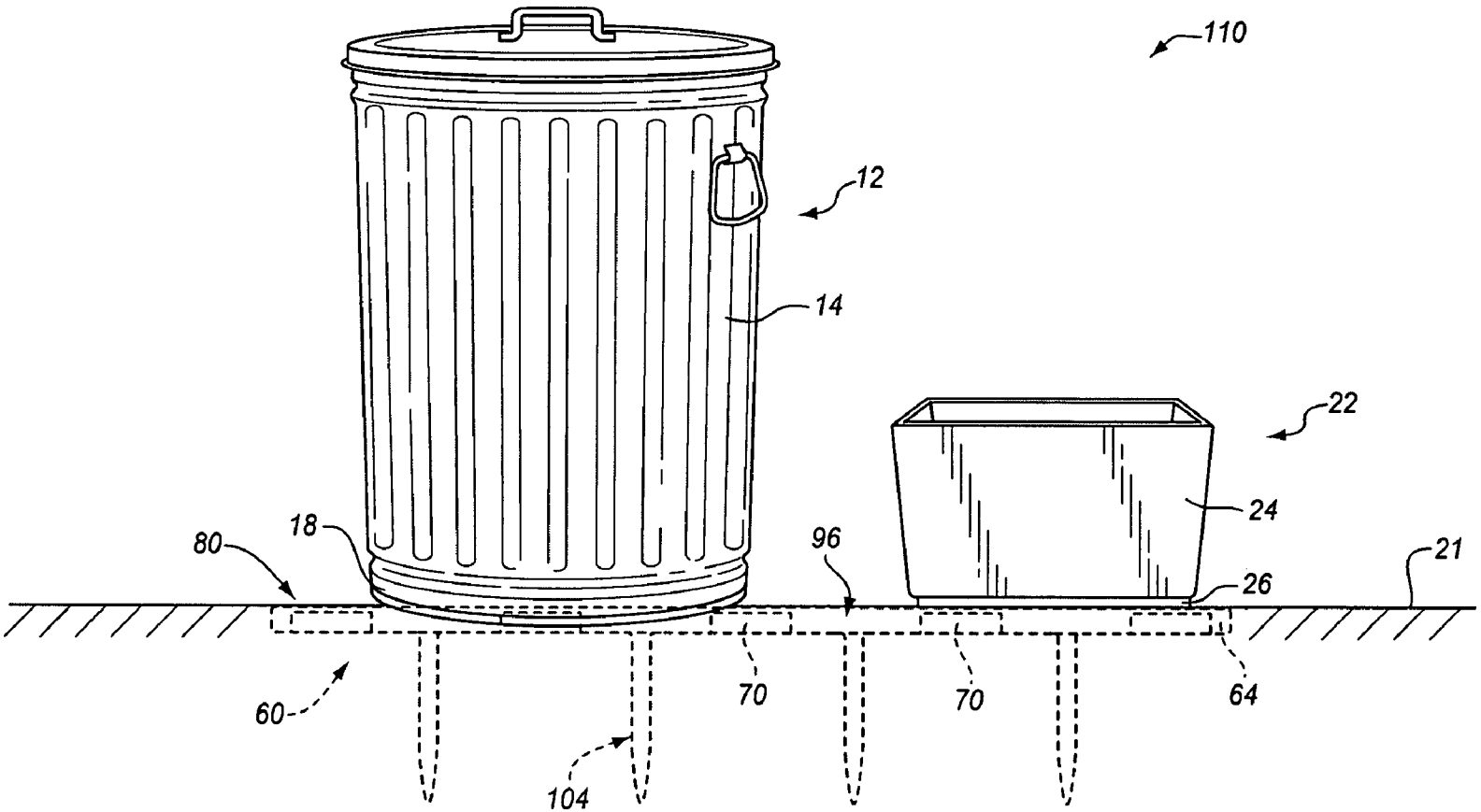
FIG. 8 is a side elevational view of the magnetic grid shown in FIG. 5 together with the trash can and recycle bin of FIG.

The magnet grid 20, shown in FIG. 2, is fixed to or mounted in the ground, or in an asphalt or concrete driveway with the magnets 40, at or slightly below the surface, preferably at the surface as shown in FIG. 2 or approximately 0.25 inch above the ground. The structure for fixing or attaching the elongate magnetizable metal bar units 52, 54, 56 and 58 to or in the ground can include cement or grout or other fastening structure and a grout formed holding structure is shown in FIGS. 6-8 and described below.

According to the teachings of the present invention, each of the cans, containers, or receptacles such as the trash can 12, is provided with the magnetizable metal plate 18 or 26, at or on the bottom surface thereof, which can be fixed with an adhesive such as an epoxy or with fasteners . . . .

In use, the can, container, or receptacle such as the trash can 12, is taken out to a trash or garbage pick up area where the magnet grid 20, is located and placed thereon. The loaded trash cans, recyclable receptacles, or other cans or containers which are placed on the magnet grid 20, will stay there of their own volition because of the weight of the material in each of these cans, containers or receptacles and by the magnetizing force of the grid 20 embedded in the ground, asphalt or concrete. It is to be understood that once the trash collector arrives and empties those cans, containers, or receptacles, such as the trash can 12, they will then be much lighter and easily can be blown away when placed back onto the ground.

However, in the waste container holding system 10, of the present invention the magnet grid 20 creates a magnetic holding force with the magnetizable metal plate 18 or 26, on the bottom of each container or receptacle when the container or receptacle 12 or 22, is placed on the grid 20 of magnets. This strong magnetic holding force has been found in empirical tests to hold the containers 12, in place at winds up to twenty-five miles per hour (25 m.p.h.). It is believed that the magnet container holding system 10, of the present invention will hold empty containers having magnetizable plates on the bottom thereof at even higher wind speeds, up to half (1/2) gale force winds of thirty-five miles per hour (35 m.p.h.) or more. In the empirical tests it was found that covers could be blown off if they were not fastened securely to the top of the can, container, or receptacle.

It is to be noted that while magnets have been placed in receptacles for holding receptacles to a magnetizable metal surface and although many different structures for fixing a container to a fence or ground with straps or frameworks or halters or stakes have been proposed, heretofore, a magnetic trash can holding system comprising a magnetic grid 20 to hold trash cans and garbage cans having magnetizable metal plates on the bottom thereof has not been proposed. The embodiment of the present invention shown in FIGS. 1-3 provides a waste container holding system for holding the cans 20 by the magnetic forces created between the grid 20 of magnets 40 and bars 32, 34, 36 and 38 and the magnetizable plates 18, 26, on the bottom of each container body 14 or 24.

Figure 4:
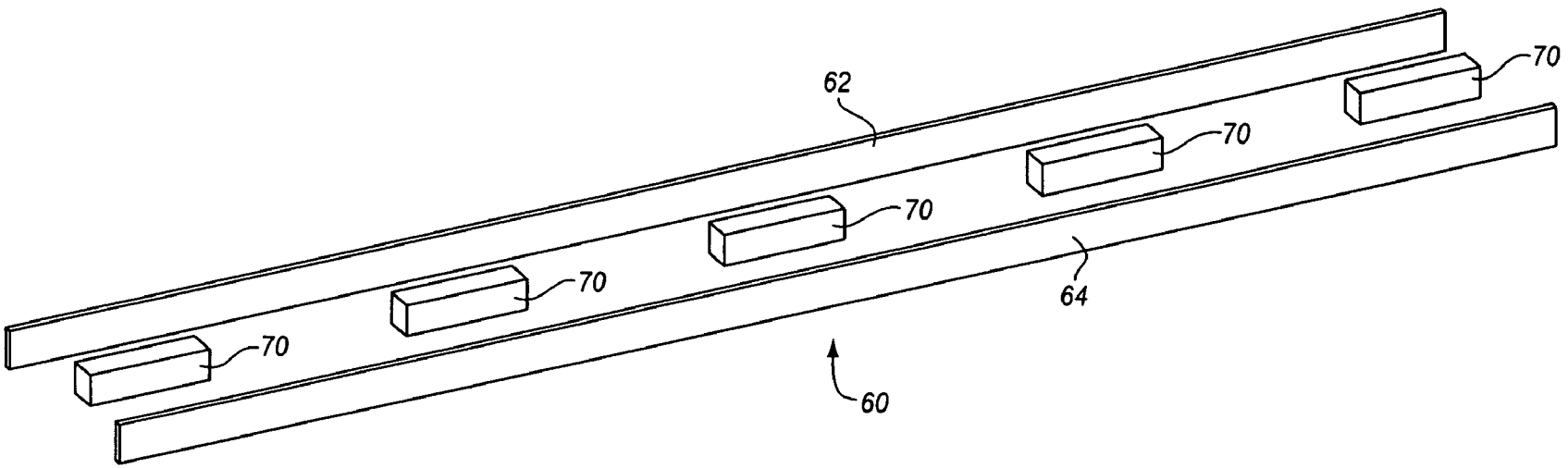
FIG. 4 is an exploded perspective of another elongate magnetizable metal bar units constructed according to the teachings of the present invention.

In FIG. 4 there is illustrated another form of an elongate magnetizable metal bar unit 60. The unit 60 includes two elongate bars 62 and 64 substantially identical to each of the elongate bars 32, 34, 36 and 38. The unit 60 further includes five (5) magnets 70 substantially identical to the magnets 40. While four sets of bars 62 and 64 and twenty magnets 70 are provided in a kit for constructing a grid 80 (FIG. 5), the magnets 70 are not fixed by an adhesive, epoxy or other fastening material or device to the bars 62 and 64, but are provided loose and, when assembled, held together in an elongate magnetizable metal bar unit 60 by magnetic attraction.

It is to be understood that the smallest kit of elongate magnetizable metal bar units 60 will include at least two bars 62 and two bars 64, each at least two (2) feet long and four (4) magnets 70.

In one preferred embodiment, the bars 62 and 64 are made of cold rolled steel and are approximately 4 feet long by approximately 1 and ¼ inches (1.25") wide by approximately ⅛ inches (0.125") thick. The magnets are preferably grade 8 ceramic magnets and are approximately 4 inch long with a cross-section approximately 1 inch by 1 inch.

The kit of twenty (20) magnets 70 and eight (8) bars 62 and 64 are used to create the magnetic grid 80 of four elongate magnetizable metal bar units 60 shown in FIG. 5. In fixing the elongate magnetizable metal bar unit 60 to the ground, first, an elongate groove, approximately 4 feet by 1.25 inch wide and approximately 1 inch deep is formed in the earth surface 21 and the bars 62 and 64 are placed parallel spaced into the grove with approximately 0.25 inch of the bar 62 or 64 extending above the ground surface 21. Then the five (5) magnets 70 are placed between the bars 62 and 64 to hold them together and form one elongate magnetizable metal unit 60. This procedure is repeated three more times to form three more parallel spaced elongate magnetizable metal bar units 60 to form the grid 80 inserted in the ground surface 21.

The spacing between each unit 60 is between 3 and 6 inches. In one preferred embodiment the spacing was approximately 4.25 inches. The end magnets 70 are each placed approximately 1 inch inwardly from the outer ends of the bars 62 and 64. This leaves an inner spacing in the space 96 between each two magnets 70 of approximately 7.50 inches.

To better secure the grid 80 in the ground surface 21, an installer can take a rod 92 such as a metal pointed rod, as shown in FIG. 6, and press it into the ground between each two magnets 70 in the elongate magnetizable metal bar unit 60 inserted in the groove in the ground and move the rod up and down to form an inverted generally cone shaped hole 94 as shown in FIG. 6. Another way to make the hole 94 is to pound a short metal rod, e.g., a two foot rod into the ground with a hammer. Four holes 94 are formed in the ground in the spaces 96 between each two magnets 70 in each elongate magnetizable metal bar unit 60 inserted in the groove. The hole 94 is generally 6 inches to one foot deep and preferably approximately one foot deep.

Next the installer inserts a fluid, but hardenable material, like plaster or concrete, and preferably non-shrinkable grout, into the holes 94 and into the spaces 96 between the magnets 70 and in the approximately 0.25 inch space above each magnet extending to an exposed upper edge 98 of each of the bars 62 and 64.

The hardenable material, i.e., non-shrinkable grout, then hardens into a unitary plug 100 as shown in FIG. 7 having an elongate portion 102 and depending pin shaped portions 104. The plugs 100 hold the elongate magnetizable metal bar units 60 to the ground and prevent the units from being pulled out of the ground.

As shown in FIG. 8, a waste container holding system 110 is formed with a one or more waste containers or garbage cans 12 and recyclable receptacles 22 and a magnetic grid 80.

The kit for assembling or constructing the magnetic grids of the waste container holding system can include a small supply of non-shrinkable grout.

From the foregoing description it will be apparent that the waste container holding system 10 or 110, of the present invention has a number of advantages as described above.

In particular, the waste container holding system 10 or 110, utilizing a magnet grid 20 or 80, does not require latches, straps, stakes or frameworks for engagement with a container, or can for preventing the can or container from being blown away. All the user needs to do is place the can, container, or receptacle, having a magnetizable metal plate fixed to the bottom thereof, onto the magnet grid and the magnetizing forces will hold the empty can, container, or receptacle to the grid even with high winds present.

The invention is defined and limited by the accompanying claims.

I claim:

1. A waste container holding system comprising: a magnetic grid including at least two, spaced, elongate magnetizable metal bar units fixed to or in a ground surface, each elongate magnetizable metal bar unit comprising at least one elongate metal bar having a length of at least two feet and at least two magnets positioned adjacent to each elongate metal bar in each elongate magnetizable metal bar unit and spaced along the length of each elongate bar, said elongate metal bar units being spaced from each other when mounted in one of the ground, asphalt or concrete with a desired spacing between said at least two elongate metal bar units, and a magnetizable plate fixed at or to a flat bottom surface of at least one waste container or in the bottom of the waste container closely adjacent to the bottom surface of the waste container and said at least one waste container being held to said magnetic grid against ambient wind by the magnetic force between said plate and said magnetic grid.

2. The waste container holding system of claim 1, wherein the magnetizable metal plate is fixed to the bottom surface of said waste container and extends across a significant portion of the bottom surface of said waste container and has a thickness between approximately 0.03 inches and approximately 0.25 inches.

3. The waste container holding system of claim 1, wherein said elongate metal bar units have a width of approximately one and one quarter inch (1¼") and a thickness of approximately one eighth inch (⅛").

4. The waste container holding system of claim 1, wherein said magnets are grade 8 ceramic magnets and each magnet has a thickness of approximately one inch (1") a width of approximately one inch (1") and a length of approximately four inches (4").

5. The waste container holding system of claim 1, wherein each elongate magnetizable metal bar unit includes two elongate metal bars with said magnets of each unit being fixed to and between said elongate metal bars by the magnetic force passing from said magnets through said elongate metal bars.

6. The waste container holding system of claim 5, wherein said magnetic grid comprises at least four (4) elongate magnetizable metal bar units including eight elongate metal bars, two for each unit and twenty magnets, five for each unit.

7. The waste container holding system of claim 6, wherein said elongate metal bars are at least four (4) feet long.

8. The waste container holding system of claim 6, wherein said elongate magnetizable metal bar units are spaced apart from each other by a distance of between 3 and 6 inches.

9. The waste container holding system of claim 5, wherein said elongate metal bars are at least four (4) feet long.

10. The waste container holding system of claim 9 wherein five (5) magnets are spaced along and between said elongate metal bars of each elongate magnetizable metal unit.

11. The waste container holding system of claim 10 wherein the magnets are each approximately four inches long and two magnets are each positioned at one end of the elongate metal bar unit and approximately one inch from the ends of the elongate metal bars with the other magnets being spaced from each other or from the end magnets by approximately seven and one half inches.

12. The waste container holding system of claim 9 including structure for fixing each elongate magnetizable metal bar unit to the ground.

13. The waste container holding system of claim 12 wherein said structure for fixing each elongate magnetizable metal bar unit to the ground includes non-shrinkable grout which is placed over and between said magnets spaced along and between said elongate metal bars.

14. The waste container holding system of claim 13 wherein a hole is punched in the ground in the space between each pair of adjacent magnets and said structure for fixing includes grout extending from each space into the ground.

15. The waste container holding system of claim 13 wherein a groove is first made in the ground for receiving the elongate metal bars up to a depth where a side edge portion of each bar extends above the ground and the magnets have a width less than the width of said elongate bars such that a space is created above each magnet when said elongate bars and magnets are placed in the groove whereby said grout fixing structure extends above said magnets and ground between said magnets to and generally flush with upper side edges of said elongate metal bars and each elongate magnetizable metal unit extends a small distance above the ground.

16. The waste container holding system of claim 15 wherein said small distance is approximately 0.25 inches.

17. The waste container holding system of claim 1 including structure for fixing each elongate magnetizable metal bar unit to the ground.

18. A kit for constructing a waste container holding system which is fixed to the ground, said kit comprising at least four metal bars each at least two feet in length and four magnets for assembling at least two elongate magnetizable metal bar units which are placed at least partly in the ground parallel spaced from each other and fixed to the ground, at least one magnetizable metal plate for being fixed to the bottom surface of or in the bottom of a waste container closely adjacent to the bottom surface thereof and means for securing and fixing to the ground the elongate magnetizable metal bar units formed from the elongate metal bars and magnets and placed in a groove in the ground.

19. The kit of claim 18, wherein the magnetizable metal plate has a thickness between approximately 0.03 inch and approximately 0.25 inch.

20. The kit of claim 18, wherein said magnets are grade 8 ceramic magnets and each magnet has a thickness of approximately one inch (1"), a width of approximately one inch (1") and a length of approximately four inches (4").

21. The kit of claim 20 including ten elongate metal bars each approximately fourfeet long, approximately 0.125 inch thick and approximately 1.25 inch wide and twenty magnets.

22. The kit of claim 18 wherein said means for securing and fixing the elongate magnetizable metal bar units to the ground comprises a supply of non-shrinkable grout for fixing the elongate magnetizable metal bar units formed from the elongate metal bars and magnets and placed in a groove in the ground to the ground.

* * * * *